US005924910A

United States Patent [19]

Liu

[11] Patent Number: 5,924,910

[45] Date of Patent: Jul. 20, 1999

[54] TOY VEHICLE WITH MOVABLE WEAPON AND BODY SHELL HALVES

[75] Inventor: Dexter C. T. Liu, Portsmouth, R.I.

[73] Assignee: LCD International L.L.C., Newport, R.I.

[21] Appl. No.: 08/965,206

[22] Filed: Nov. 6, 1997

[51] Int. Cl.[6] ..... A63H 17/26; A63H 17/00; A63H 33/00

[52] U.S. Cl. ..... 446/470; 446/435; 446/487

[58] Field of Search ..... 446/470, 471, 446/465, 456, 454, 460, 431, 434, 435, 437, 487, 489, 308, 331

[56] References Cited

U.S. PATENT DOCUMENTS

| | | | |
|---|---|---|---|
| D. 284,491 | 7/1986 | Ohno . | |
| D. 289,187 | 4/1987 | Ohno . | |
| D. 297,036 | 8/1988 | Yoke . | |
| D. 301,352 | 5/1989 | Doi . | |
| D. 302,448 | 7/1989 | Shinohara . | |
| D. 307,925 | 5/1990 | Rylands . | |
| D. 311,043 | 10/1990 | Kunihiro . | |
| D. 324,892 | 3/1992 | Kwan . | |
| D. 342,977 | 1/1994 | Appel . | |
| 2,735,221 | 2/1956 | Fields | 446/435 |
| 4,249,339 | 2/1981 | Crain et al. . | |
| 4,382,347 | 5/1983 | Murakami . | |
| 4,393,620 | 7/1983 | Murakami . | |
| 4,467,556 | 8/1984 | Iwao et al. . | |
| 4,516,948 | 5/1985 | Obara . | |
| 4,530,670 | 7/1985 | Ohno . | |
| 4,580,993 | 4/1986 | Ohno . | |
| 4,599,078 | 7/1986 | Obara . | |
| 4,623,317 | 11/1986 | Nagano . | |
| 4,655,727 | 4/1987 | Swisher et al. | 446/471 X |
| 4,668,205 | 5/1987 | Choy et al. . | |
| 4,674,990 | 6/1987 | Ohno . | |
| 4,681,554 | 7/1987 | Hsien-Yang . | |
| 4,685,894 | 8/1987 | Beny et al. . | |
| 4,737,135 | 4/1988 | Johnson et al. | 446/435 X |
| 4,750,895 | 6/1988 | Shinohara et al. . | |
| 4,891,995 | 1/1990 | Lin . | |
| 5,022,884 | 6/1991 | Hippely et al. . | |
| 5,069,649 | 12/1991 | Wu . | |
| 5,310,379 | 5/1994 | Hippely et al. | 446/435 X |
| 5,334,078 | 8/1994 | Hippely et al. . | |
| 5,360,367 | 11/1994 | Ho . | |
| 5,372,534 | 12/1994 | Levy et al. . | |
| 5,525,090 | 6/1996 | Halford et al. . | |
| 5,542,872 | 8/1996 | Ho . | |

FOREIGN PATENT DOCUMENTS

| | | | |
|---|---|---|---|
| 639-565 | 2/1979 | U.S.S.R. | 446/435 |

*Primary Examiner*—D Neal Muir
*Attorney, Agent, or Firm*—Panitch Schwarze Jacobs & Nadel, P.C.

[57] ABSTRACT

A toy vehicle includes a chassis and a pair of shell halves rotatably attached to the chassis, which in a first position form a vehicle body that bounds an interior space. A four-bar linkage is attached to the chassis and is disposed at least partially within the interior space. A pair of external finger tabs is pivotally attached to the chassis and connected with the linkage by means of pinion gears and a rack. Movement of the finger tabs together drives the linkage to raise and project a simulated weapon on the linkage and releases the shell halves to separate. Reverse movement of the tabs reverses the operation. A second toy vehicle includes a chassis and a pair of rotatable body panels and a different four-bar mechanism attached to the chassis beneath the body panels in a first position. A pair of external finger tabs is pivotally attached to the chassis. The finger tabs rotate the body panels and two arms on the body panels which bear on and move the linkage such that a simulated weapon carried on the linkage is projected from beneath the body panels as the panels open. A third toy vehicle includes components of the first two vehicles. A simulated weapon on a four-bar linkage is rotated into view with the linkage upwardly and forwardly from an initial position covered by the shell halves as the shell halves separate.

20 Claims, 14 Drawing Sheets

TOY VEHICLE WITH MOVABLE WEAPON AND BODY SHELL HALVES

BACKGROUND OF THE INVENTION

The present invention relates to toy vehicles, particularly toy vehicles having mechanisms for rotating body portions and/or simulated weapons.

Toy vehicles having mechanisms for opening portions of the body of the vehicle are known. For example, several embodiments of toy vehicles are shown in U.S. Pat. No. 5,334,078 of Hippely et al. In Hippely et al., linkage mechanisms are used to open and close portions of the toy vehicle body to simulate the opening and closing of the jaws of a creature.

Further, toy vehicles are known which have mechanisms for projecting or moving a simulated weapon relative to the remainder of the toy vehicle. For example, U.S. Pat. No. 4,249,339 of Crain et al. discloses a toy space vehicle that includes a complex mechanism which opens two hatch-like doorways while simultaneously rotating a simulated weapon about a pivot so that the weapon projects outwardly from the interior of the space vehicle through the open hatchway. Another example of a toy vehicle having a mechanism which projects a simulated weapon from the toy vehicle is shown in U.S. Pat. No. 5,022,884 of Hippely et al., which discloses in FIG. 8, a toy truck having a hatch and a missile that rotate on a common axis to alternately close the hatch or project the missile through the opened hatch.

It would be desirable to provide a toy vehicle which had a mechanism that opened portions of the vehicle body and simultaneously moved a simulated weapon through a path of motion more complex than simple rotation about a pivot, so as to increase the play value, without the complexity of existing toy vehicles.

BRIEF SUMMARY OF THE INVENTION

In a first aspect, the present invention is a toy vehicle comprising a chassis and a pair of shell halves rotatably attached to said chassis and forming a vehicle body in a first position, said vehicle body bounding an interior space. A linkage is attached to said chassis and is disposed at least partially within said interior space. A pair of finger tabs is pivotally attached to said chassis and connected with said linkage and said pair of shell halves, said finger tabs being disposed externally of said shell halves and rotatable with respect to each other and said chassis, such that movement of said figure tabs drives said linkage and rotates said shell halves.

In a second aspect, the present invention is a toy vehicle comprising a chassis and at least one body panel rotatably attached to said chassis. A four-bar linkage is attached to said chassis and disposed at least partially beneath said body panel in a first position. At least one simulated weapon is attached to said four-bar linkage and at least one finger tab is rotatably attached to said chassis and connected with said four-bar linkage and said body panel. Said finger tab drives said linkage and biases said body panel such that said simulated weapon is projected from beneath said body panel and into view.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 1:
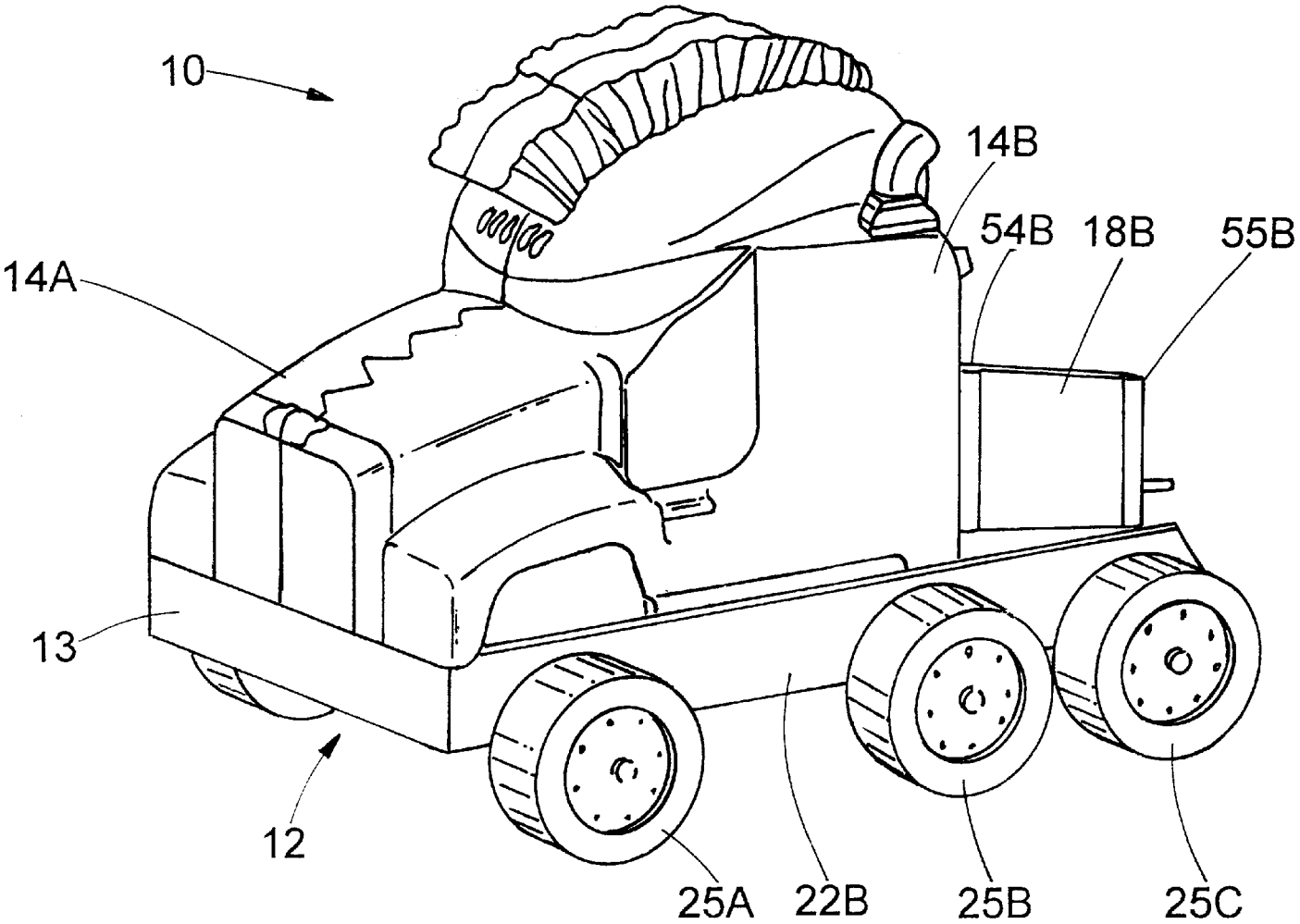
FIG. 1 is a first perspective view of a toy vehicle in accordance with a first embodiment of the present invention.
Figure 2:
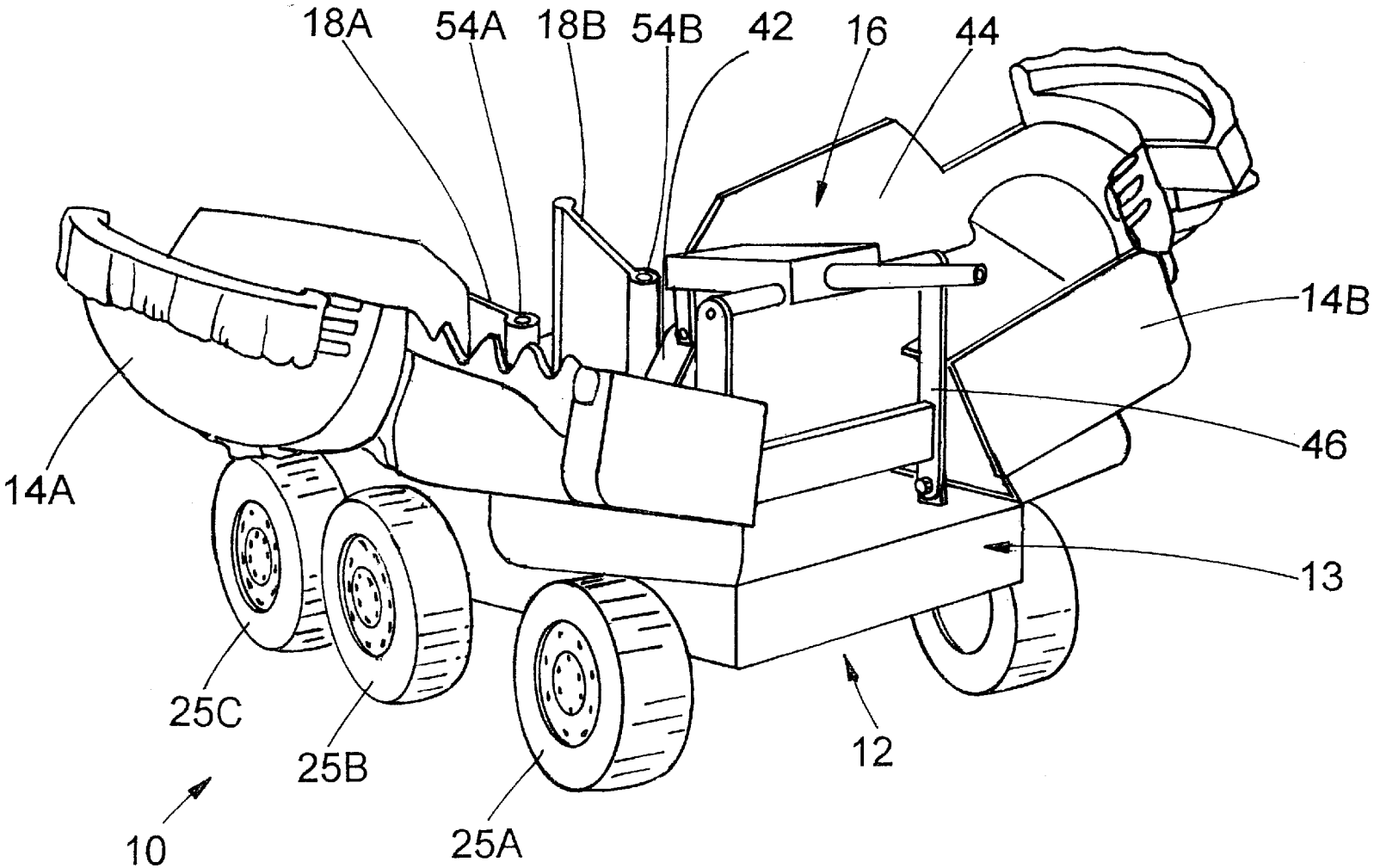
FIG. 2 is a second perspective view of the first embodiment toy vehicle showing the shell halves in an open position.

Certain terminology is used in the following description for convenience only and is not limiting. The words "right," "left," "lower," "upper," "upward" and "downward" designate directions in the drawings to which reference is made. The words "front," "frontward" and "rear," "rearward" refer to directions toward and away from, respectively, a designated front section of the toy vehicle. The word "inner", "inward" and "outer", "outward" refer to directions toward and away from the centerline of the toy vehicle. The terminology includes the words above specifically mentioned, derivatives thereof and words of similar import.

Referring now to the drawings in detail, wherein like numerals are used to indicate like elements throughout, there is shown in FIGS. 1–9 a first preferred embodiment of a toy vehicle 10. The toy vehicle 10 is primarily comprised of a chassis 12, a pair of shell halves 14A, 14B rotatably attached to the chassis 12, a linkage 16 attached to the chassis 12 and a pair of finger tabs 18A, 18B pivotally attached to the chassis 12 and connected with the linkage 16.

Figure 6:
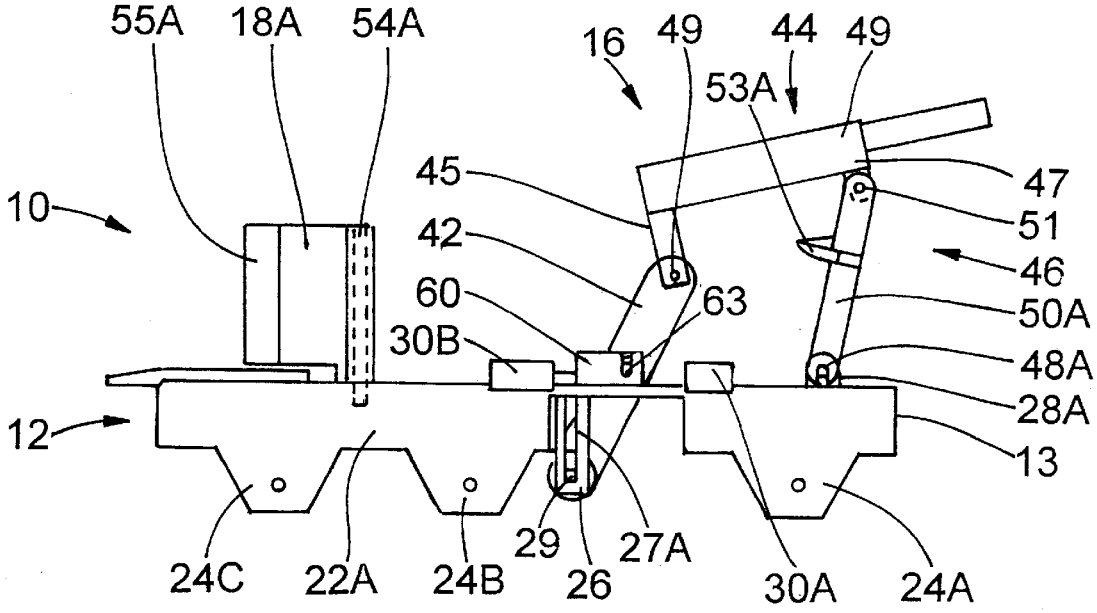
FIG. 6 is a side plan view of the toy vehicle shown in FIG. 5.

Referring to FIGS. 1–9, the chassis 12 is preferably a rectangular box-like structure having a front section 13, a generally flat, rectangular base wall 20 and at least two side walls 22A, 22B extending downwardly from opposite longitudinal edges of the base wall 20. Referring specifically to FIG. 6, the chassis 12 preferably includes three pairs of wheel mounts 24A–24C spaced along the two side walls 22A, 22B. Each pair of wheel mounts 24 may be a pair of openings configured to rotatably attach an axle (not shown) having two attached wheels 25 to the chassis 12, although one or more of the pairs of wheel mounts 24 could alternatively be two individual wheel mounts (e.g. stub shafts, not shown) each configured to attach a single wheel 25, such as in a "snap-on" manner.

Further, the chassis 12 includes a first, rear pair of pivot supports 26A, 26B disposed near and spaced laterally across the center of the base wall 20 and extending downwardly from the lower surface thereof to pivotally support one of the links. Preferably, each rear pivot support 26A, 26B is an elongated member having a slot 27 (FIGS. 6 and 7) configured to receive a section of a pin, as described below. A second, front pair of pivot supports 28A, 28B is disposed on and spaced laterally across the upper surface of the base wall 20 near the front 13 of the chassis 12. Each front pivot support 28A, 28B preferably includes an opening configured to receive a portion of a pin, as described below. The chassis 12 also includes a rectangular slot 32 disposed along a longitudinal centerline 19 of the base wall 20 and the vehicle 10 and extending between the rear pair of pivot supports 26A, 26B.

To rotatably support the shell halves 14A, 14B, two pairs of hinge supports 30, 31 are preferably disposed on and spaced longitudinally along either longitudinal side of base wall 20. Each hinge support 30A, 30B and 31A, 31B of each pair of hinge supports 30 and 31 is configured to receive a hinge portion of a shell half, as described in further detail below.

Furthermore, the chassis 12 may be provided with automotive detailing, such as a fifth wheel 33 (FIGS. 3 and 5), and/or frame, suspension, motor and drive train details. The detailing may be three dimensional and functional or non-functional or merely non-functional surface ornamentation provided to simulate such functional elements.

Wheeled toy vehicles of the present invention include at least two wheels connected to a chassis. Vehicle 10 includes six wheels 25A–25F, attached in pairs 25A/25B, 25C/25D and 25E/25F to wheel mounts 24A, 24B and 24C. However, it is also within the scope of the present invention to construct the chassis 12 in a non-wheeled configuration as long as the toy vehicle 10 is capable of functioning as described below. For example, the chassis 12 could be formed as a ship or other aquatic vehicle (not shown), an airplane (not shown), or any other type of non-wheeled vehicle, with the chassis being constructed without wheel mounts and including other features, such as wings, a hull, skids, etc. The present invention is intended to encompass all such alternative vehicle types and corresponding alternative constructions of the chassis 12.

Preferably, the chassis 12 is a one-piece construction having the above-described pivot supports 26A, 26B, 28A, 28B, hinge supports 30A, 30B and 31A, 31B and wheel mounts 24A–24C. However, it is within the scope of the present invention to construct the chassis 12 of two or more pieces and/or to attach separate pivot supports, hinge supports and/or wheel mounts (e.g. stub shafts, not shown) to the base wall 20 or side walls 22A, 22B of the chassis 12.

Referring now to FIGS. 1–3 and 9, as described above, the toy vehicle 10 includes at least one body panel 14, and preferably a pair of body panels or shell halves 14A, 14B rotatably attached to the chassis 12. Each shell half 14A, 14B is preferably a thin-walled, four sided box-like structure lacking an "inner" side facing the other shell half and a "bottom" side facing the chassis. The shell halves 14A, 14B are preferably substantially mirror images of each other about the centerline 19. Preferably, each shell half 14A, 14B is a one-piece construction, although is it within the scope of the present invention to construct each shell half 14A, 14B of two or more separate pieces joined together and/or with additional accessories, such as for example, windows or simulated diesel exhaust pipes. Although it is preferred to have a pair of shell halves 14A, 14B, it is within the scope of certain aspects of the present invention to construct toy vehicles having a single body panel (not shown) rotatably attached to a chassis or having a two-piece body (not shown) with a first portion fixedly attached to the chassis and a second portion rotatably attached to the first portion, such as with a fixed vehicle body having a movable hatch or hood.

Figure 4:
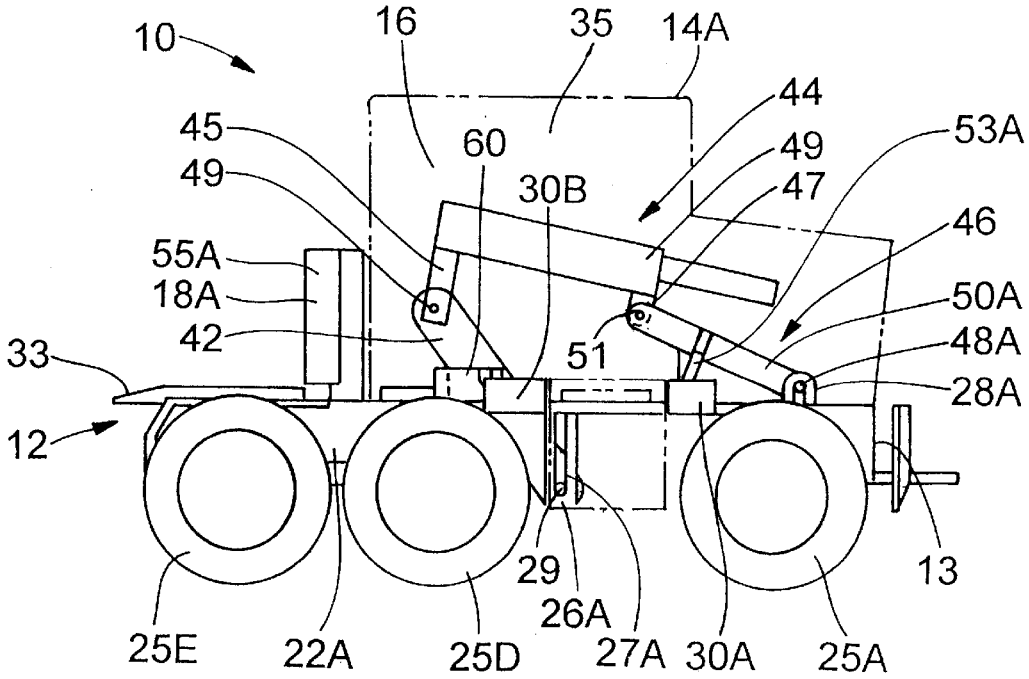
FIG. 4 is a side plan view of the toy vehicle shown in FIG. 3.
Figure 5:
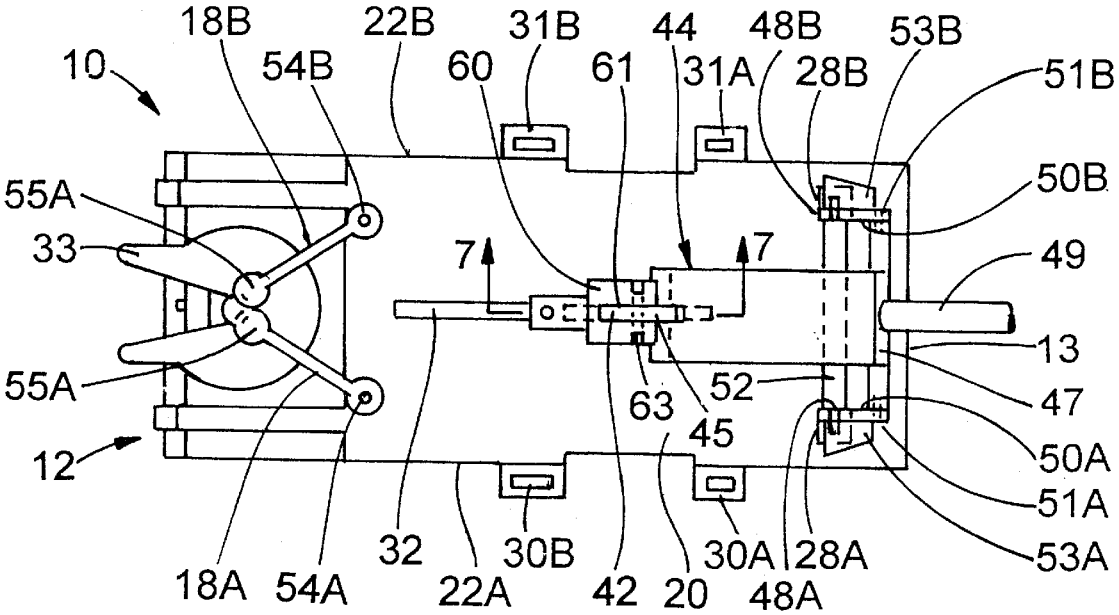
FIG. 5 is a top plan view of the first embodiment toy vehicle, showing the linkage in a second position.
Figure 9:
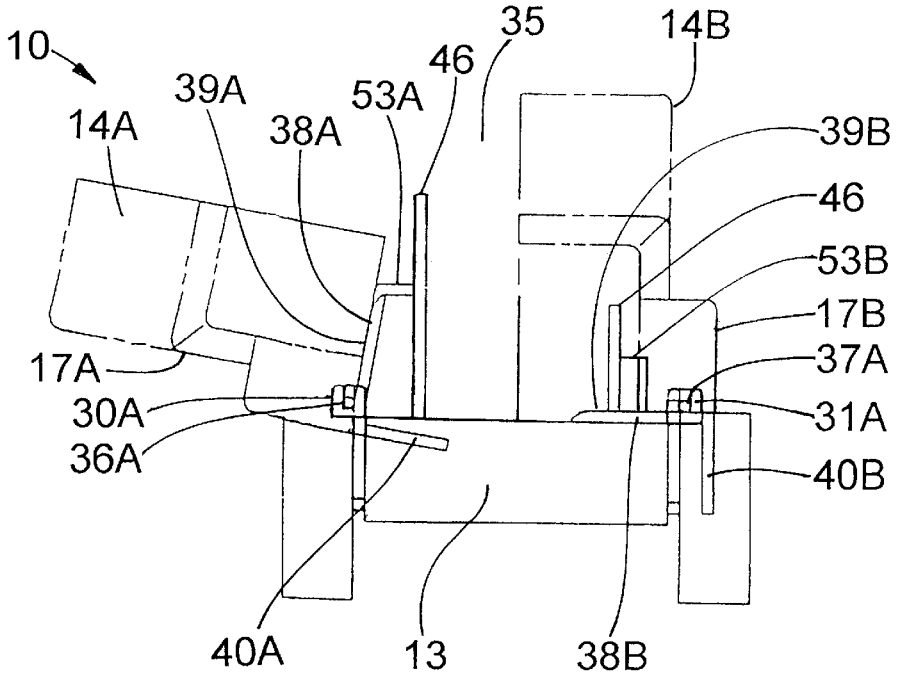
FIG. 9 is a front plan view of the first embodiment toy vehicle, showing one-half of the linkage mechanism and one shell half in the first position and the other half of the linkage and the other shell half in a second position.
Figure 10:
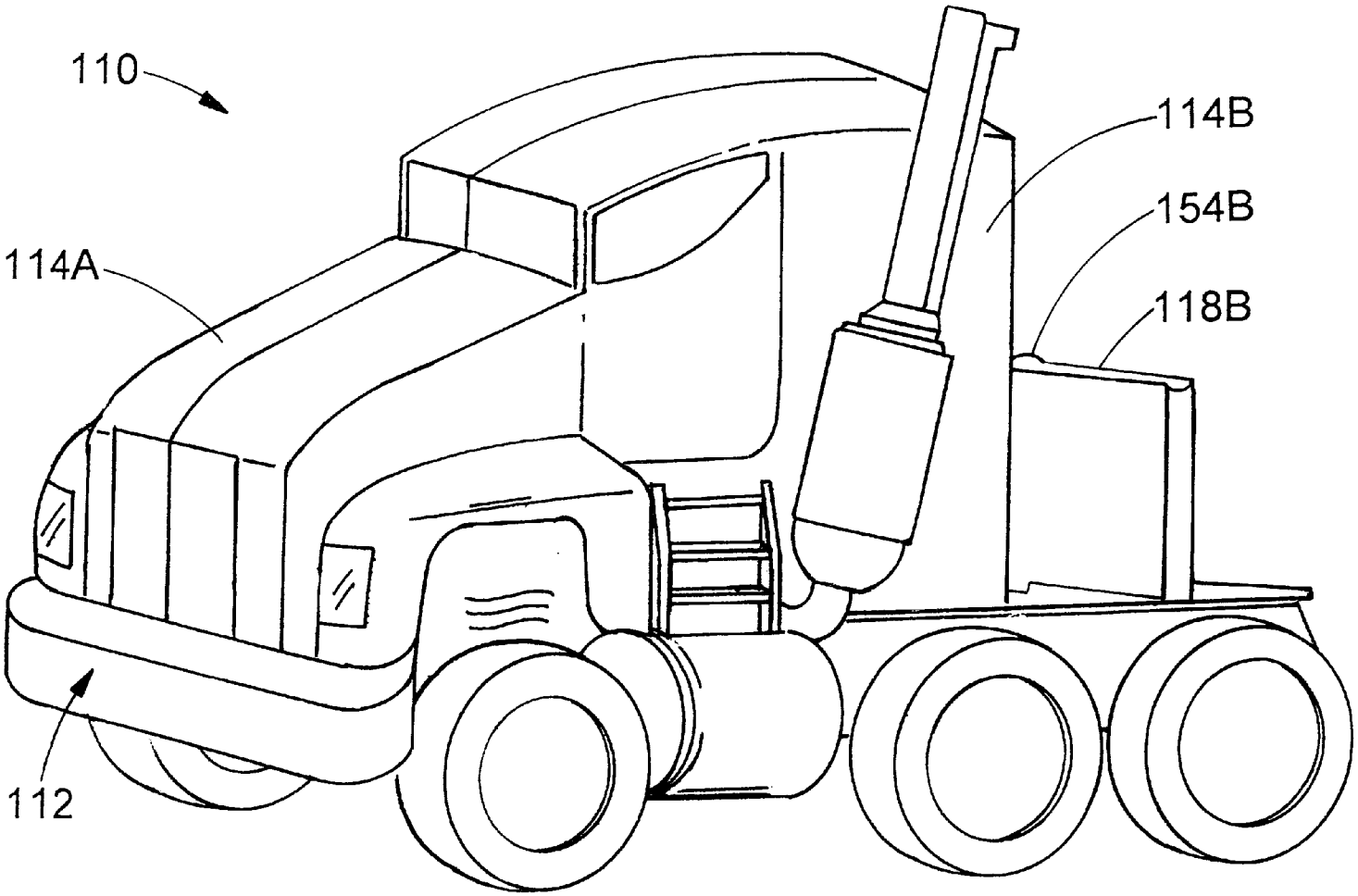
FIG. 10 is a first perspective view of a toy vehicle in accordance with a second embodiment of the present invention.
Figure 11:
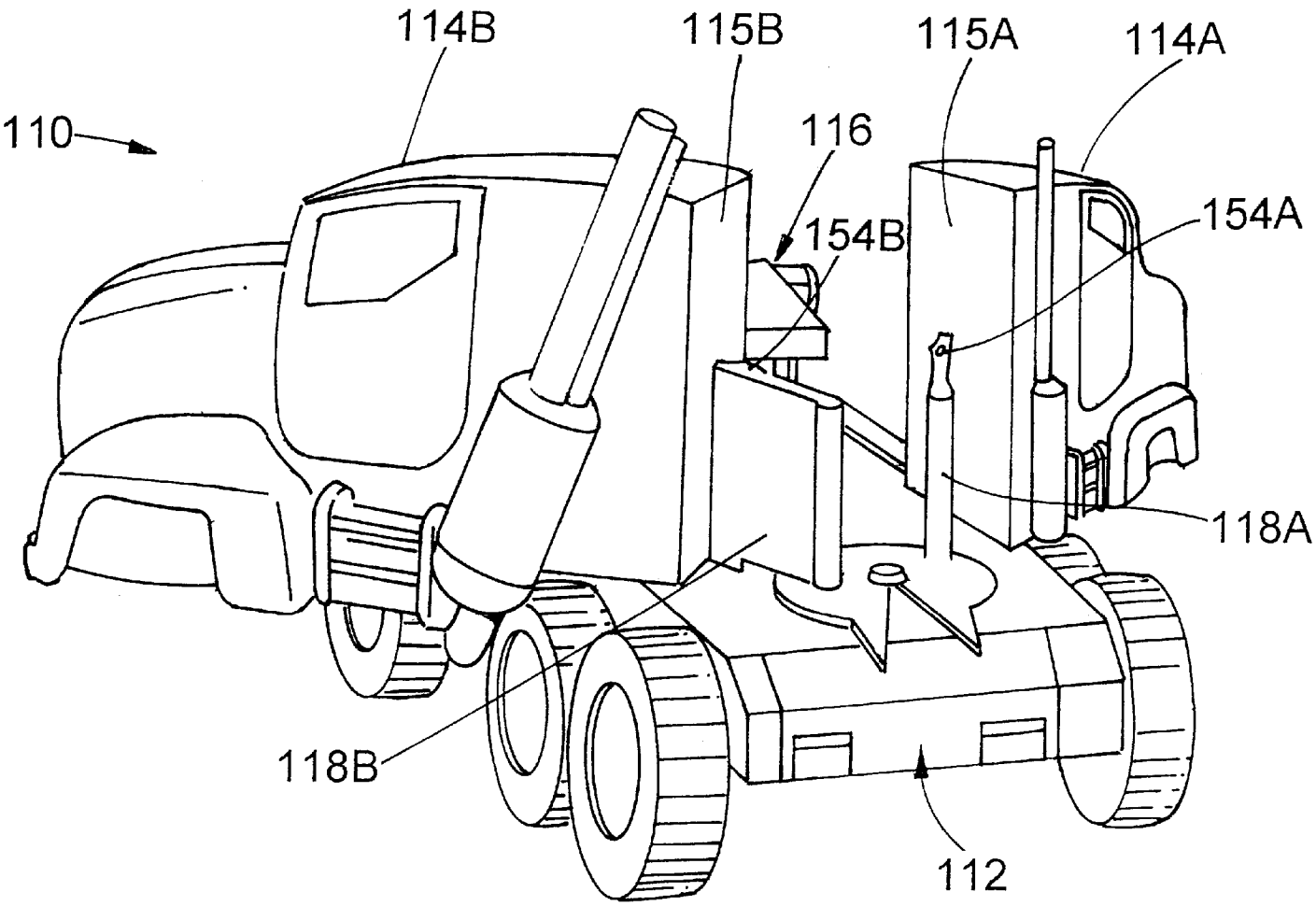
FIG. 11 is a second perspective view of the second embodiment toy vehicle, shown generally from the rear with the shell halves in an open position.

As shown in FIG. 1, the pair of shell halves 14A, 14B form a vehicle body 34 in a first position and, as shown in FIGS. 4 and 9, bound an interior space 35. Preferably, the shell halves 14A, 14B form in the first position a caricature of a head of a human, a humanoid, an animal or a fantastical creature, as best shown in FIG. 1, with each shell half 14A, 14B having half the features of the particular caricature. Further, the shell halves 14A, 14B together also form the basic appearance of a wheeled vehicle, such as a truck, automobile, or van, when located in the first position, so that the formed vehicle body 34 preferably has a dual appearance of both a vehicle and a caricature.

Figure 3:
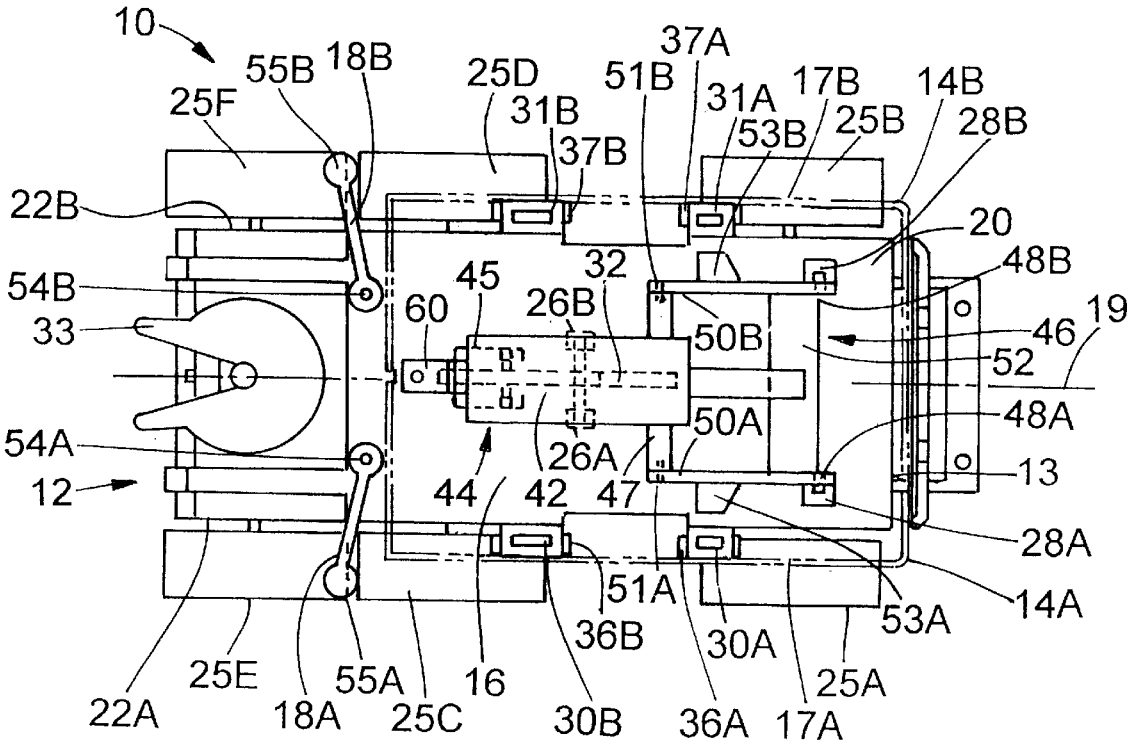
FIG. 3 is a top plan view of the first embodiment toy vehicle, showing the linkage in a first position.

Preferably, as shown in FIGS. 3 and 9, each shell half 14A, 14B is attached to the chassis 12 by engaging a pair of hinge portions 36A, 36B or 37A, 37B at a lower longitudinal edge of the shell half 14A, 14B with one of the pairs of hinge supports 30A, 30B or 31A, 31B. However, it is within the scope of the present invention to attach the shell halves 14A, 14B by one or several hinge portions or one or more separate hinges (not shown). The engagement of the hinge portions 36, 37 with the hinge supports 30, 31, respectively, enables each shell half 14A, 14B to be rotatable within a plane(s) perpendicular to a horizontal plane and longitudinal centerline 19 through the chassis 12.

As best shown in FIG. 9, the shell halves 14A, 14B each include an inwardly-extending ledge 38A, 38B, respectively, disposed on the inner surface of a side wall 17A, 17B, each ledge 38A, 38B having an upper surface 39A, 39B, respectively. Further, each shell half 14A, 14B preferably includes a stop portion 40A, 40B, respectively, extending downwardly between the pair of hinge portions 36 or 37 to prevent the shell halves 14A, 14B from rotating outwardly more than about ninety degrees from the first position, as shell half 14A is shown in FIG. 9.

Referring to FIGS. 2–9, the linkage 16 is arranged on the chassis 12 such that it is disposed at least partially within the interior space 35 bounded by the pair of shell halves 14A, 14B when in the first position. Most preferably, the linkage 16 is at least hidden from view from above the vehicle 10 when the shell halves 14A, 14B and the linkage 16 are both in initial or first positions, as described below.

The linkage 16 is preferably a four-bar linkage, most preferably of the double-rocker variety, and includes a driver link 42, a connecting link 44, a driven link 46 and the section of the chassis 12 between the rear pivot supports 26A, 26B and the front pivot supports 28A, 28B. All three links 42, 44, 46 move in a plane which extends vertically and longitudinally through the vehicle 10 along centerline 19 and which is parallel to the planes of FIGS. 4 and 6. The driver link 42 is movably or rotatably attached to the chassis 12 between, and is connected with, the finger tabs 18A, 18B as described below. The driver link 42 is disposed between and rotatably attached to the pivot supports 26A, 26B at a lower end of the link 42 by a single pin 29 or two pin sections (not shown) extending into each slot 27A, 27B of the respective pivot support 26A, 26B. Further, the driver link 42 extends through the slot 32 in the base wall 20 of the chassis 12 and through a slot in a connective member, as described below, so as to generally intersect a horizontal plane through the chassis 12. Preferably, the driver link 42 is constructed as a generally flat rectangular member.

Referring to FIGS. 3–6, the connecting link 44 has a first end 45 and a second end 47, the first end 45 being pivotally connected to the driver link 42 by a pin connection 49 and the second end being pivotally connected to the driven link 46 by a pin connection 51. The connecting link 44 extends longitudinally along the center of the base wall 20 of the of the chassis 12 and moves along a path in the plane extending vertically and longitudinally through the vehicle 10. The connecting link 44 is rotatable with respect to both the driver and driven links 42 and 46, respectively.

Preferably, as shown in FIGS. 2–6, the connecting link 44 is shaped so as to form a simulated weapon 49. However, it is within the scope of the present invention to have a separate simulated weapon (not shown) attached to a connecting link 44 constructed having a more conventional appearance, such as for example, a flat bar or a T-shaped link (neither shown), so as to be similarly; carried by the linkage 16.

Referring now to FIGS. 2–6 and 9, the driven link 46 is rotatably attached to the upper surface of the base wall 20 of the chassis 12. Preferably, the driven link 46 is disposed between the front pair of pivot supports 28A, 28B on the upper surface of the base wall 20 and is attached at a lower end to the supports 28A, 28B by two separate pin connections 48A, 48B, respectively. The driven link 46 extends so as to generally intersect the base wall 20 and is at least partially rotatable within the vertical plane in generally frontward and rearward directions.

Preferably, the driven link 46 is generally U-shaped and includes two side members 50A, 50B and a cross member 52 extending between and connecting each side member 50A, 50B near the lower ends thereof. The upper ends of the two side members 50A, 50B of the driven link 44 are preferably connected with opposite sides of the second end 47 of the connecting link 44 by two separate pin connections 51A, 51B, respectively.

Preferably, the driven link 46 further includes a pair of manipulating arms 53A, 53B, each extending outwardly from and substantially perpendicular to a separate one of the side members 50A, 50B, respectively, such that the manipulating arms 53A, 53B extend from opposite sides of the linkage 16. Each manipulating arm 53A, 53B is preferably a substantially flat, short rectangular plate. The manipulating arms 53A, 53B coact with the ledges 38A, 38B respectively of the shell halves 14A, 14B as described in detail below.

Referring again to FIGS. 1–6, the finger tabs 18A, 18B are disposed rearwardly on and spaced laterally across the upper surface of the base wall 20 and are located externally of the shell halves 14A, 14B. Each finger tab 18A, 18B is rotatable both with respect to each other and to the chassis 12 within a plane(s) parallel to a horizontal plane through the chassis 12 and vehicle 10.

Preferably, each finger tab 18A, 18B includes an elongated shaft 54A, 54B extending through, and substantially perpendicular to, the base wall 20 of the chassis 12 to pivotally attach the finger tab 18A or 18B to the chassis 12. Each finger tab 18A, 18B is preferably a generally rectangular-shaped plate having two enlarged sections along opposite vertical sides, one through which the shaft 54A, 54B extends and the other providing a gripping portion 55A, 55B to accommodate a user's finger(s).

Figure 8:
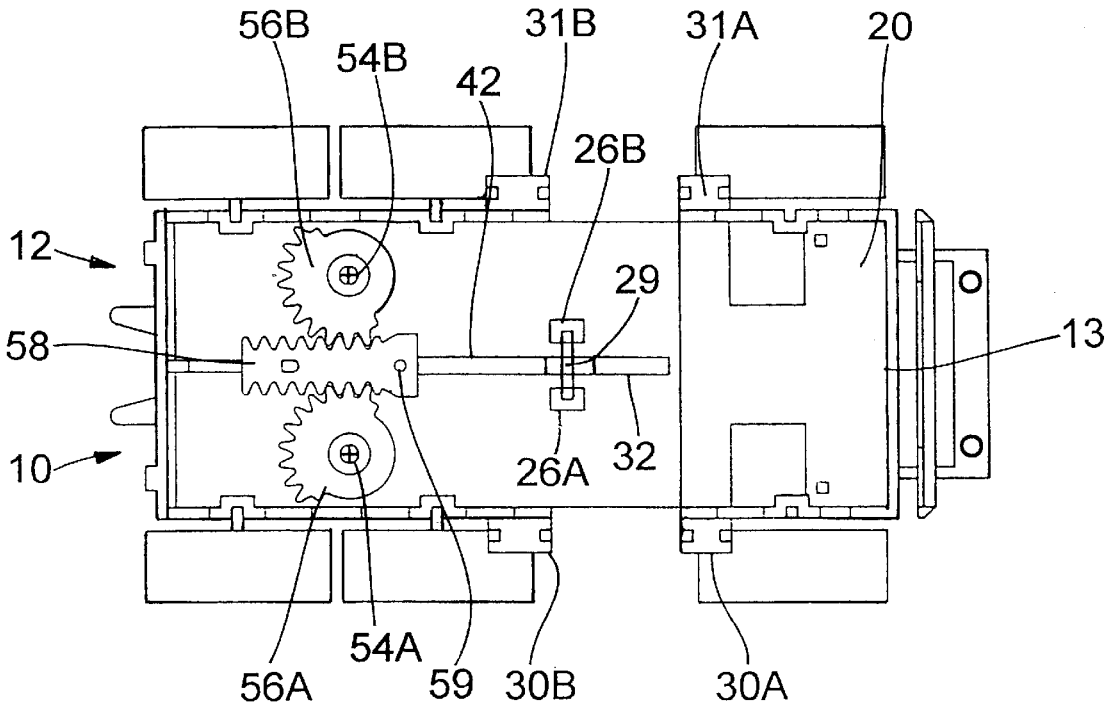
FIG. 8 is a bottom plan view of the first embodiment toy vehicle.

Preferably, the toy vehicle 10 further comprises at least one pinion gear 56 attached to one of the finger tabs 18A or 18B and a gear rack 58 engaged with the pinion gear 56, as described in detail below. Referring to FIG. 8, more preferably two pinion gears 56A, 56B are provided, each attached to a separate one of the finger tabs 18A, 18B, and each engaged with opposite sides of the gear rack 58. Each pinion gear 56A, 56B is attached to the lower end of a separate shaft 54A, 54B extending below the base wall 20, and the gears 56A, 56B are spaced apart from each other laterally across the lower surface of the base wall 20. Also, it is within the scope of the present invention to replace one or both of the pinion gears 56A or 56B with a friction wheel, an idler wheel or even a stop (none shown) and to appropriately replace the double-sided gear rack 58 with a single-sided rack or friction member (neither shown).

The gear rack 58 is displaceably attached to the chassis 12 and disposed between the two pinion gears 56A, 56B. The rack 58 extends longitudinally along the lower surface of the base wall 20 and is connected at its forward end with the linkage 16. The gear rack 58 preferably has teeth on two opposite longitudinal sides which engage the gear teeth of the pinion gears 56A, 56B.

Figure 7:
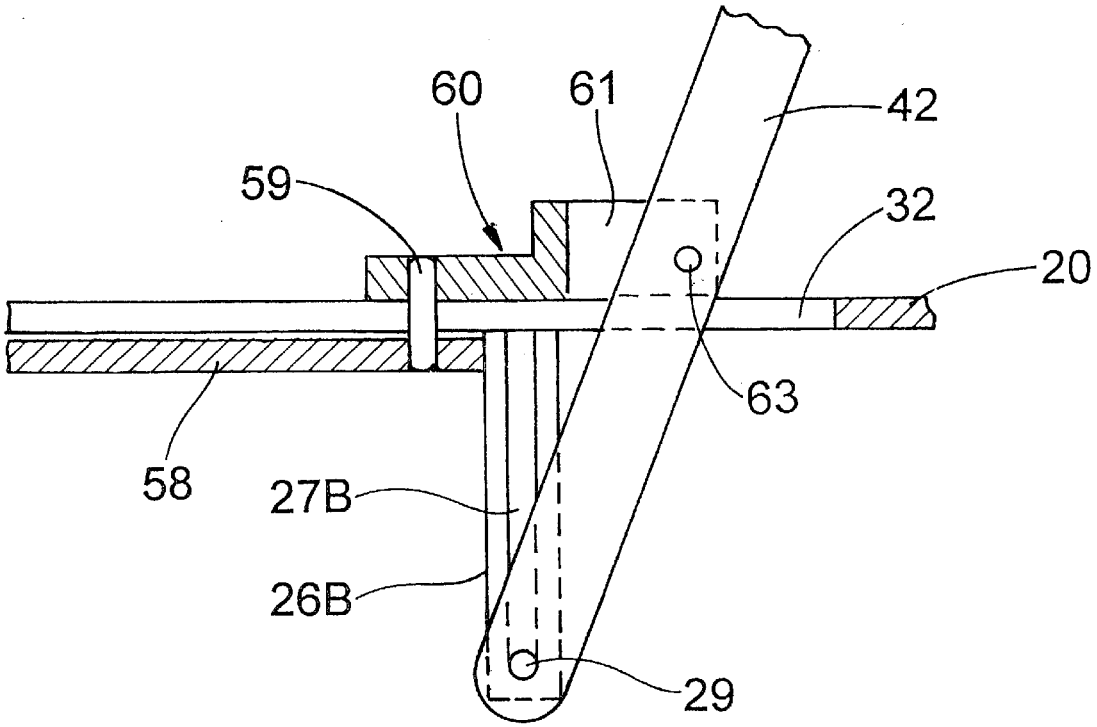
FIG. 7 is an enlarged view along line 7—7 of FIG. 5.

Referring now to FIGS. 3–7, the first embodiment toy vehicle 10 preferably includes a connective member 60 that connects the gear rack 58, and thus the finger tabs 18A, 18B, to the linkage 16. Referring particularly to FIG. 7, the connective member 60 is disposed on the upper surface of the base wall 20 of the chassis 12 and is preferably constructed as a single block having a smaller solid section and a larger clevis section. The connective member 60 is attached to the gear rack 58 by a fastener 59 that extends between the smaller solid section of the connective member 60 and the front end of the gear rack 58 through the slot 32 in the base wall 20, thereby displaceably attaching both the connective member 60 and the gear rack 58 to the chassis 12. The connective member 60 is slidably disposed within and displaceable along the slot 32 in frontward and rearward directions with the gear rack 58.

The clevis section of the connective member 60 includes a vertical slot 61 through which extends a central section of the driver link 42 of the linkage 16. The driver link 42 is connected to the connective member 60 by a pin 63 so that the driver link 42 is rotatable with respect to the connective member 60. The connective member 60 thus connects the gear rack 58 to the linkage 16 and rotates the shell halves 14A, 14B so that movement of the finger tabs 18A, 18B drives the linkage 16 and rotates the shell halves 14A, 14B, as described in further detail below.

Preferably, all the above-described elements of the toy vehicle 10 are formed in a conventional fashion. For example, with the exception of the pins, the vehicle parts are molded from a polymeric material, such as thermoplastic, by an appropriate molding process. The pins and axles may be cut from aluminum rod, although the pins could also be molded from plastic or cut from steel rod. However, it is within the scope of the present invention to construct any or all of the elements of the toy vehicle 10 of another appropriate material, such as aluminum or steel, or rubber for the wheels, and to use any other appropriate manufacturing process, such as, for example, casting or stamping.

Referring again to FIGS. 1–9, in the use of the first embodiment toy vehicle 10 generally, movement of the finger tabs 18A, 18B drives the linkage 16 in a rearward to frontward direction in the vertical plane and rotates the shell halves 14A, 14B within a plane(s) perpendicular to a horizontal plane through the chassis 12 and to the vertical plane extending longitudinally through the vehicle 10 and the chassis 12. The movement of the linkage 16 moves the simulated weapon 49 along a path in the vertical plane and into view.

More specifically, when the shell halves 14A, 14B and the linkage 16 are in a first position as described above, a user grasps the finger tabs 18A, 18B and pushes the finger tabs 18A, 18B toward each other. Movement of the finger tabs 18A, 18B in a direction toward each other rotates the pinion gears 56A, 56B in the same relative directions, which moves the gear rack 58. The gear rack 58 moves frontwardly until the front end thereof reaches the rear surfaces of the pivot supports 26A, 26B, which prevent further forward movement of the gear rack 58. The movement of the gear rack 58 in a frontward direction displaces the connective member 60 along the slot 32 in a frontward direction so that the connective member 60 drives or "pushes" the linkage 16 in a frontward direction to a second position.

The connective member 60 bears on the driver link 42 causing it to rotate within the rear pivot supports 26A, 26B in a frontward direction and causing the connecting link 44 to move frontwardly and the driven link 46 to rotate within the front pivot supports 28A, 28B in a frontward direction. The relative size of the links 42, 44 and 46 and their orientation in the second or frontward position is such that movement of the linkage 16 to the second position causes the simulated weapon 49 to move simultaneously both perpendicularly upward from, and frontwardly parallel with a horizontal plane through the chassis 12, along a path in the vertical plane.

Further, as the finger tabs 18A, 18B move toward each other, the shell halves 14A, 14B rotate away from each other to open the interior space 35. More specifically, movement of the linkage 16 in the first or frontward direction, as described above, moves the manipulating arms 53A, 53B of the driven link 46 along the upper surfaces 39A, 39B of the ledges 38A, 38B of the shell halves 14A, 14B, respectively, in a first or frontward direction as the arms 53A, 53B simultaneously move upwardly. The upward movement of the manipulating arms 53A, 53B allow the ledges 38A, 38B to move upwardly, and thus enable connected shell halves 14A, 14B to rotate within the hinge supports 31, 32 both outwardly and away from each other under the influence of gravity.

Referring again to FIGS. 1–9, when the linkage 16 and the shell halves 14A, 14B are in the second position, movement of the finger tabs 18A, 18B away from each other causes the shell halves 14A, 14B to rotate toward each other while the simulated weapon 49 is moved perpendicularly downward toward, and rearwardly parallel with a horizontal plane through the chassis 12 in a reverse direction along the path in the vertical longitudinal plane. More specifically, rotation of the finger tabs 18A, 18B toward each other rotates the pinion gears 56A, 56B in relative directions such that the gear rack 58 is displaced in a rearward direction, thereby causing the connective member 60 to drive or "pull" the linkage 16 in a rearward direction.

The rearward movement of the linkage 16, and thus the driven link 46, moves the manipulating arms 53A, 53B rearward along the upper surfaces 39A, 39B of the ledges 38A, 38B respectively, which causes the shell halves 14A, 14B to rotate toward each other to their first position. In other words, as the manipulating arms 53A, 53B move rearwardly, they push down on the ledges 38A, 38B so that the shell halves 14A, 14B rotate within the hinge supports 30, 31, respectively, both upwardly and inwardly toward their first position. In the first position, the shell halves 14A, 14B re-form the vehicle body 34 and the caricature discussed above, so that the simulated weapon 49 is again hidden from view. Thus, the finger tabs 18A, 18B rotate the shell halves 14A, 14B, at least in one direction.

Referring now to FIGS. 10–17, there is shown a second embodiment of a toy vehicle 110. The second embodiment of the toy vehicle 110 is similar to the first embodiment of the toy vehicle 10 and functions in a similar manner, as described below. The primary differences between the second embodiment of the toy vehicle 110 and the first embodiment of the toy vehicle 10 are described in detail below.

As shown in FIGS. 10–17, the second embodiment of the toy vehicle 110 also comprises a chassis 112, a pair of body panel shell halves 114A, 114B, a linkage 116 and a pair of finger tabs 118A, 118B, each element being similar to the corresponding element in the first embodiment of the toy vehicle 10. The chassis 112 has only a front pair of pivot supports 128A, 128B and does not include hinge supports. Further, the shell halves 114A, 114B are each rotatably attached to the chassis 112 through a separate one of the finger tabs 118A, 118B, respectively. Preferably, each finger tab 118A, 118B is attached to an exterior surface of a separate one of the shell halves 114A, 114B, most preferably to the rear wall 115A, 115B of the particular shell half 114A, 114B. Each shell half 114A, 114B and connected finger tab 118A, 118B rotate as a unit about the shaft 154A, 154B of the finger tab 118A, 118B. Rotation of each finger tab 118A, 118B about the respective shaft 154A, 154B simultaneously pivots the connected shell half 114A, 114B about the shaft 154A, 154B, so that movement of the finger tabs 118A, 118B toward each other moves the shell halves 114A, 114B away from each other, and vice-versa.

Figure 12:
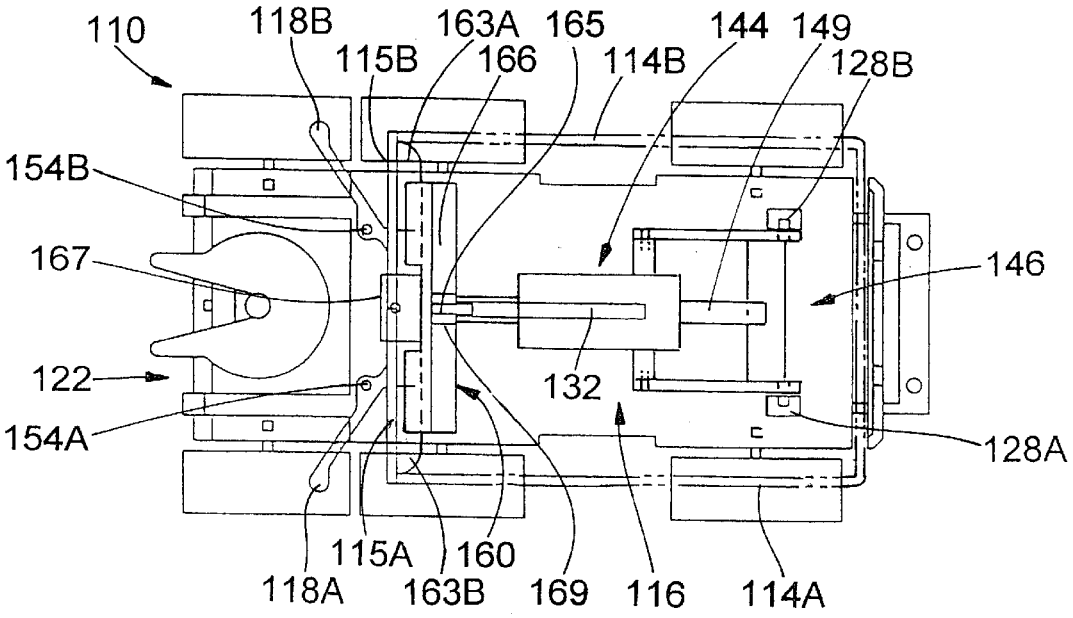
FIG. 12 is a top plan view of the second embodiment of the toy vehicle, showing the linkage in a first position.
Figure 13:
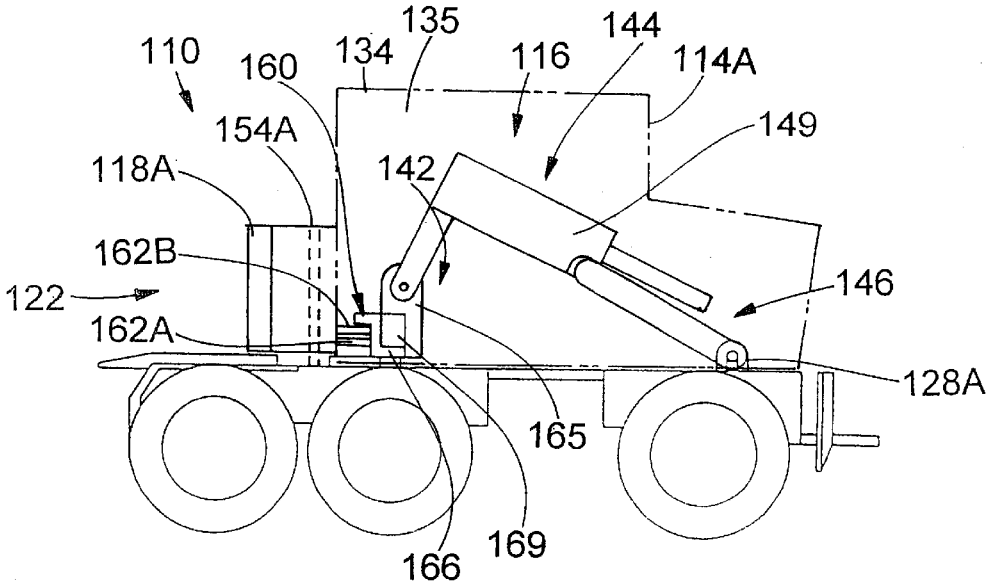
FIG. 13 is a side plan view of the second embodiment toy vehicle as shown in FIG. 12.
Figure 14:
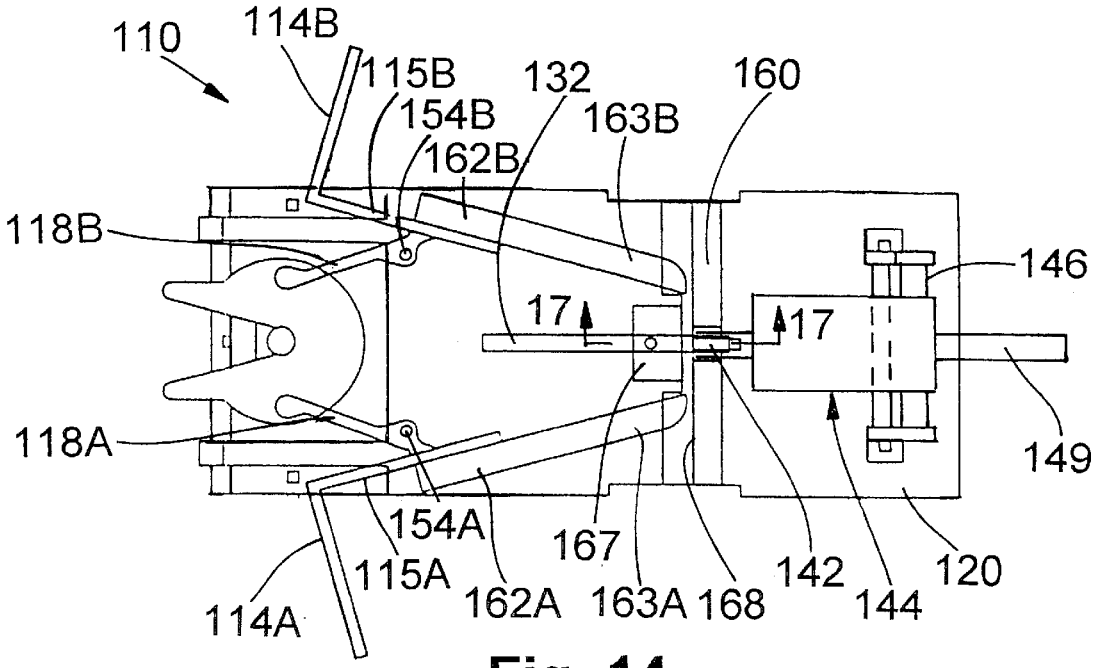
FIG. 14 is a top plan view of the second embodiment toy vehicle, showing the linkage in a second position.
Figure 15:
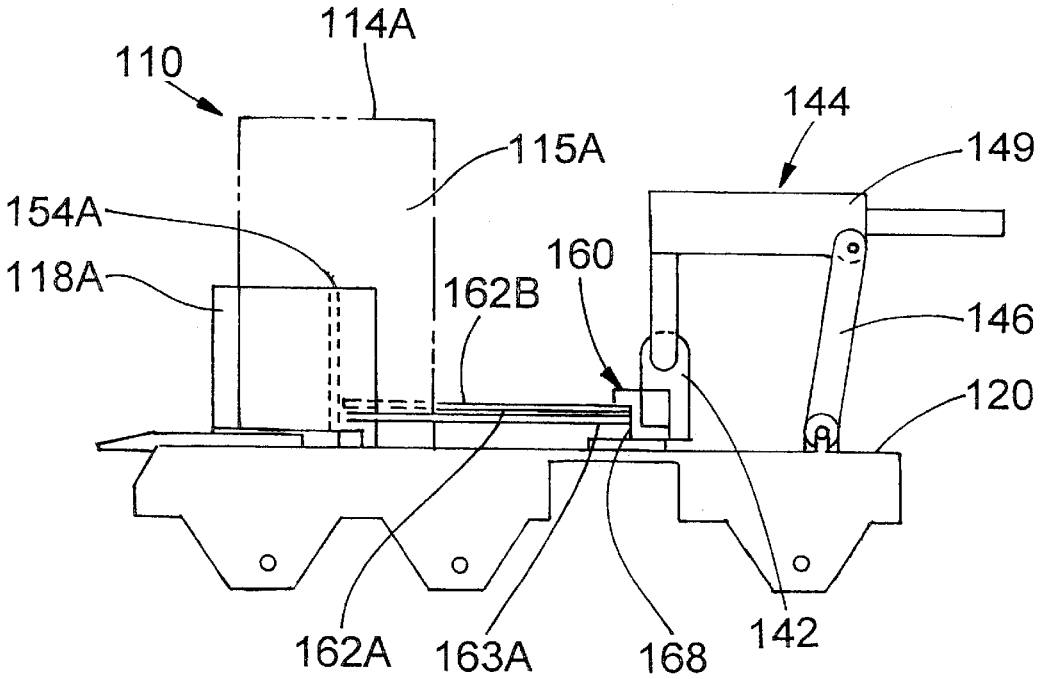
FIG. 15 is a side plan view of the second embodiment toy vehicle shown in FIG. 14.
Figure 16:
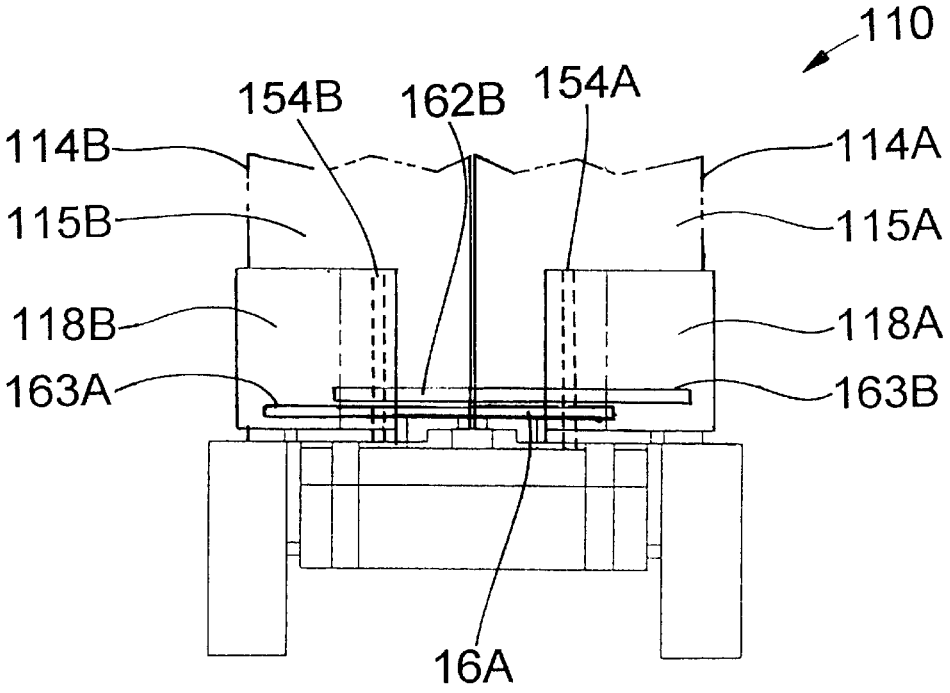
FIG. 16 is a rear plan view of the second embodiment toy vehicle.

Referring to FIGS. 12–15 and 17, each shell half 114A, 114B includes a transmitting arm 162A, 162B extending from an interior surface of the shell half 114A, 114B. Each transmitting arm 162A, 162B is preferably a flat, elongated member that extends horizontally along the rear wall 115A, 115B of the respective shell half 114A, 114B and has a free end 163A, 163B that extends beyond the inner edge of the rear wall 115A, 115B. The transmitting arms 162A, 162B are disposed so that one transmitting arm 162B of one shell half 114B overlaps the other transmitting arm 162A of the other shell half 114A when the shell halves 114A, 114B are in their initial or first position, as shown in FIGS. 12, 13 and 16.

Figure 17:
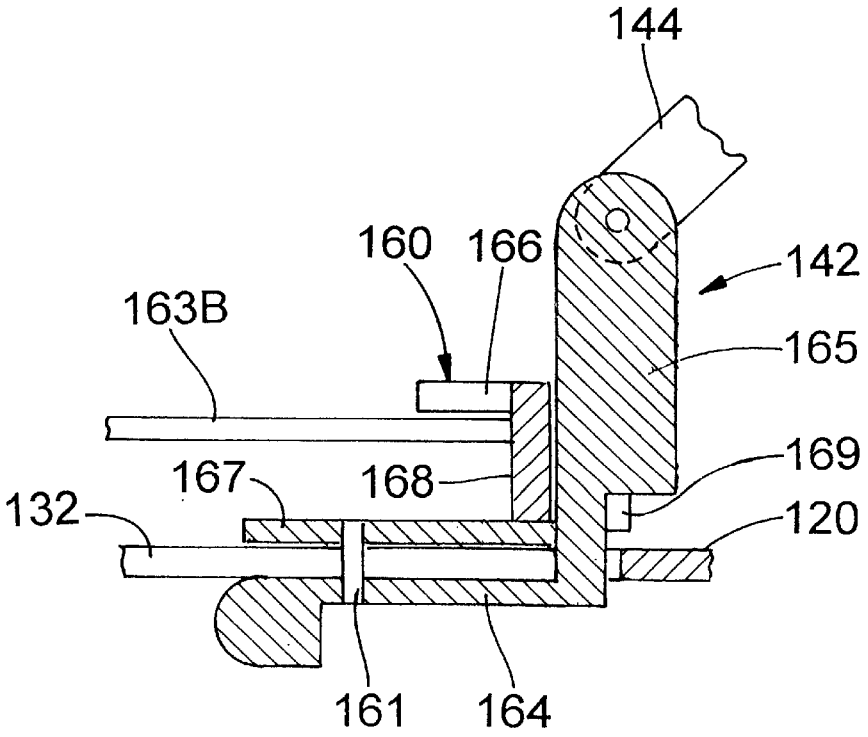
FIG. 17 is an enlarged view along line 17—17 of FIG. 14.
Figure 18:
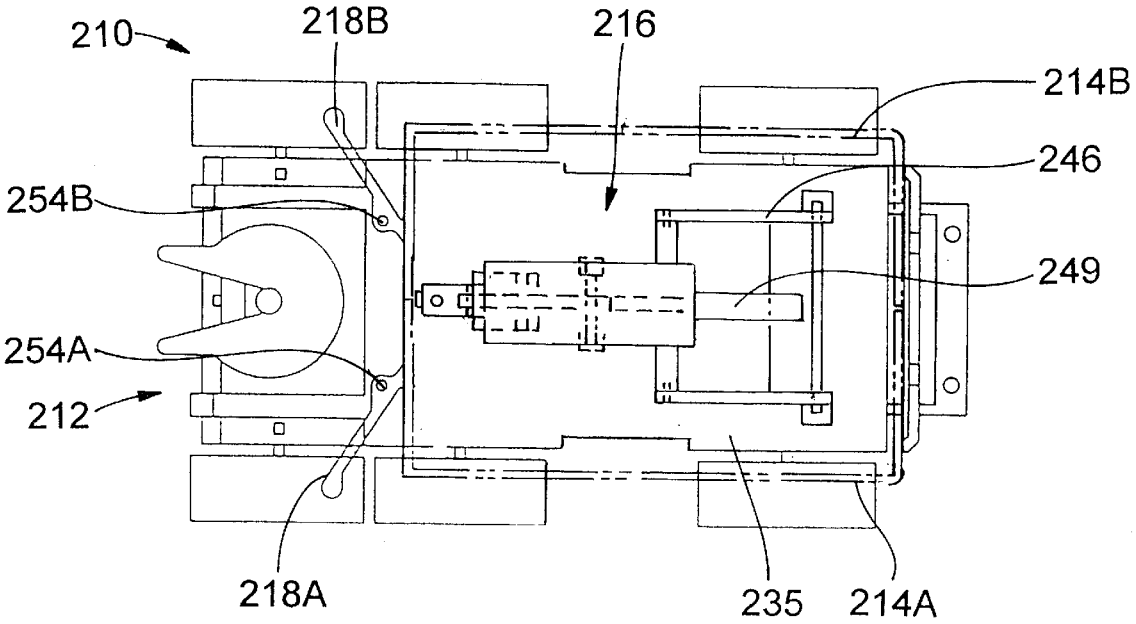
FIG. 18 is a top plan view of a toy vehicle in accordance with a third embodiment of the present invention, showing the linkage in a first position.
Figure 19:
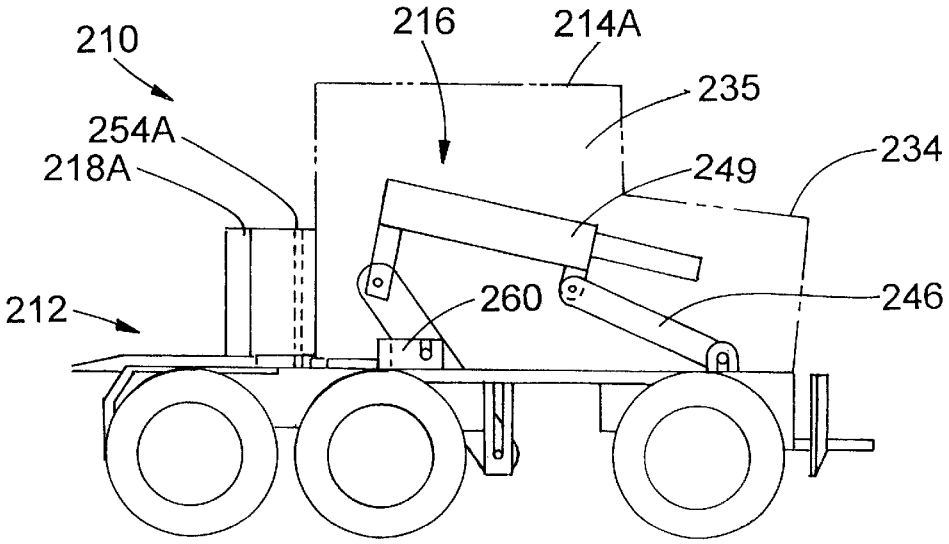
FIG. 19 is a side plan view of the third embodiment toy vehicle shown in FIG. 18.
Figure 20:
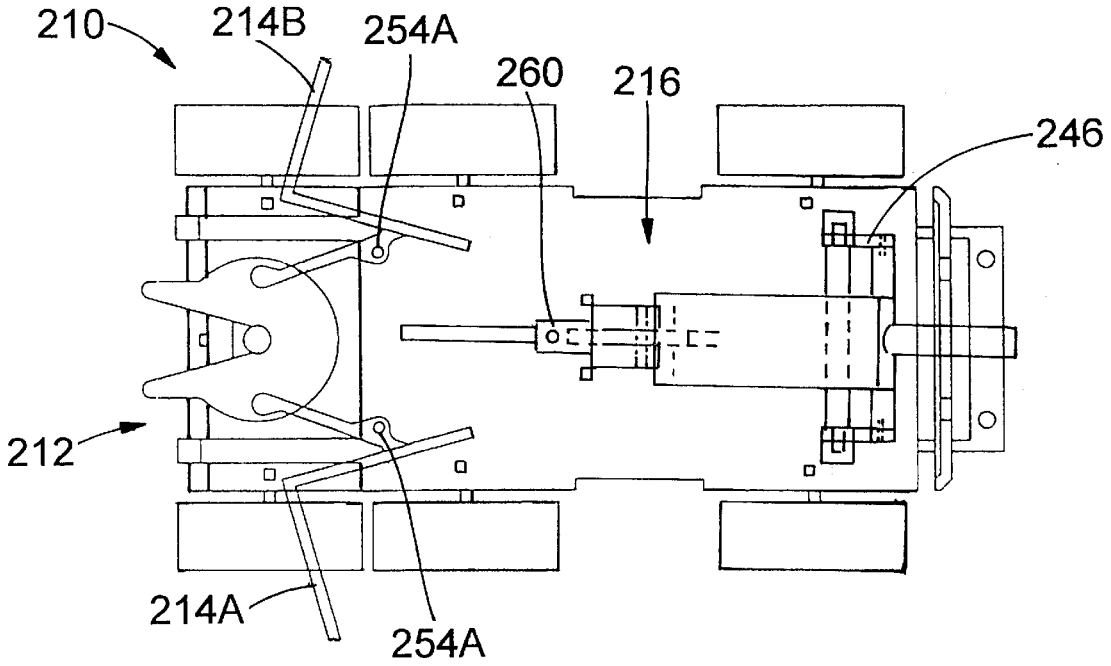
FIG. 20 is a top plan view of the third embodiment toy vehicle, showing the linkage in a second position.
Figure 21:
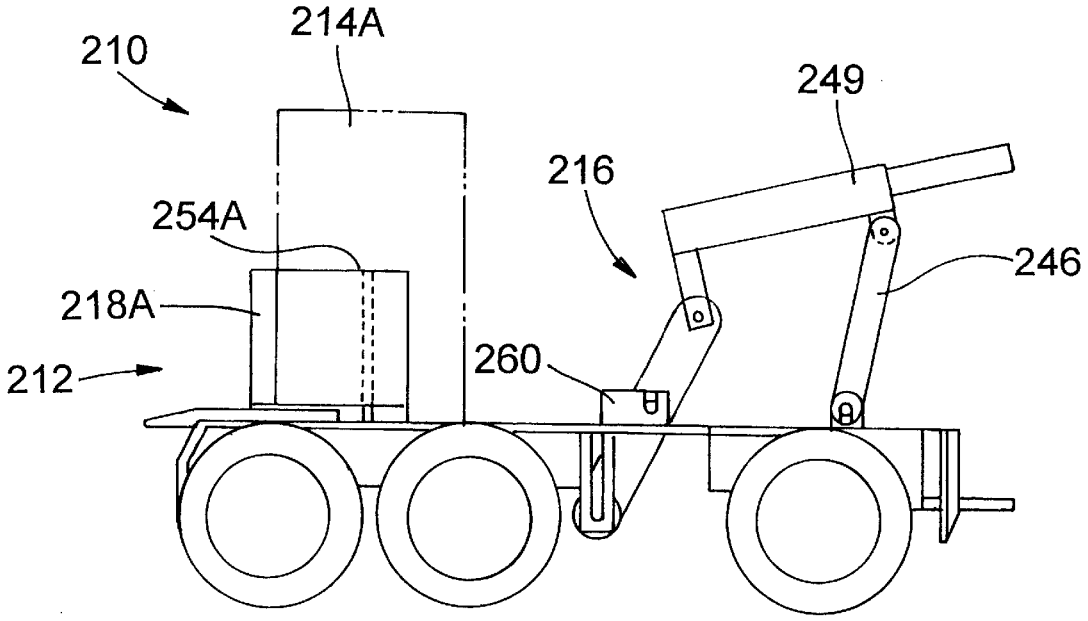
FIG. 21 is a side plan view of the third embodiment toy vehicle shown in FIG. 20.
Figure 22:
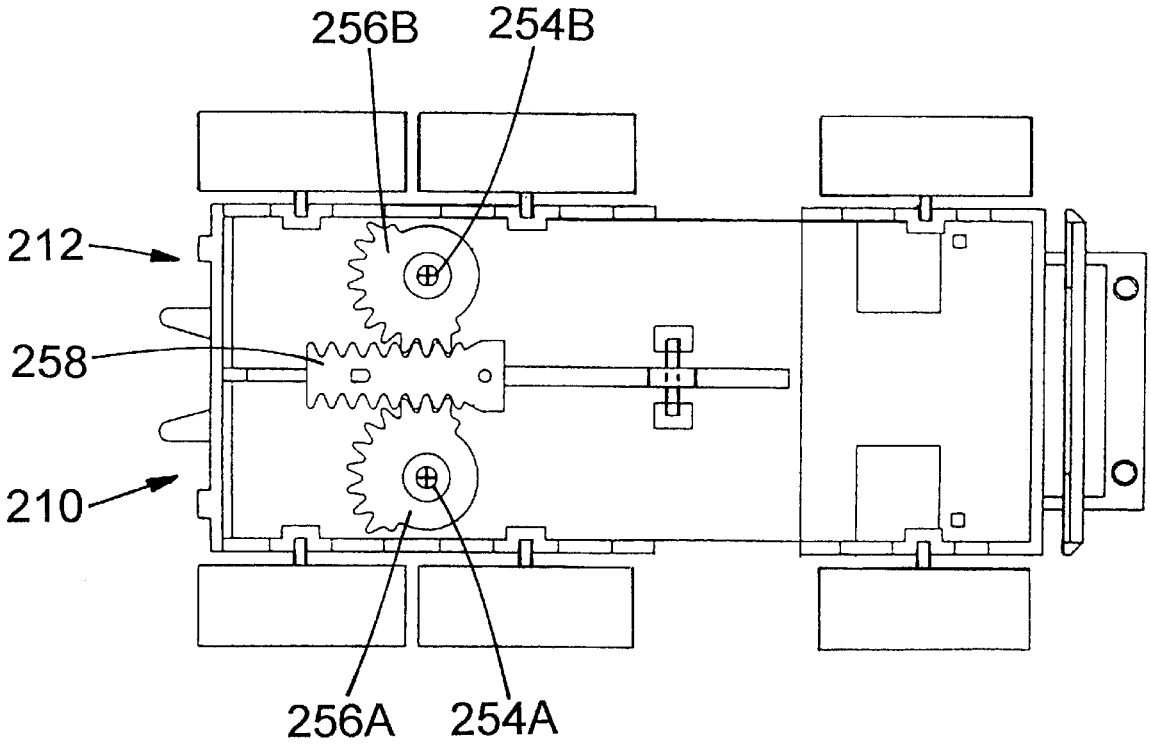
FIG. 22 is a bottom plan view of the third embodiment toy vehicle.

Referring now to FIGS. 12–15, the primary difference between the second embodiment of the toy vehicle and the first embodiment of the vehicle is the linkage 116, which is a slider-crank four-bar linkage as opposed to the double-rocker four-bar linkage in the first embodiment. The differences between these linkages are primarily dictated by the different configurations of the driver links 42 and 142. The driver link 142 has a lower horizontal section 164 and an upper vertical section 165 extending from the front end of the horizontal section 164. As best shown in FIG. 17, the horizontal section 164 of the driver link 142 is disposed below the lower surface of the base wall 120 of the chassis 112 and the vertical section 165 extends through the slot 132 in the base wall 120 and generally perpendicular to a horizontal plane through the chassis 112. The driver link 142 is attached to the chassis 112 by a pin 161 extending between the horizontal section 164 and a connective member 160 through the slot 132, as further described below, so that the driver link 142 is slidably attached to the base wall 120 of the chassis 112. The connecting link 144 is substantially identical to the connecting link 44 of the first embodiment. The driven link 146 is substantially identical to the driven link 46 of the first embodiment except that the driven link 146 does not include manipulating arms (53A, 53B).

Referring to FIGS. 12–15 and 17, the connective member 160 includes an upper elongated bar section 166 extending laterally across the upper surface of the base wall 120 of the chassis 112 and a lower rectangular plate section 167 (FIG. 17) disposed near the center of the bar section 166. The connective member 160 has an upright contacting surface 168 on the rear side of the bar section 166 upon which the transmitting arms 162A, 162B act. As best shown in FIG. 17, the plate section 167 is disposed on the upper surface of the base wall 120 across the slot 132 and is attached to the horizontal section 164 of the driver link 142 by the pin 161, as described above, to thereby secure the connective member 160 to the chassis 112. Further, the vertical section 165 of the driver link 142 extends through a slotted portion 169 of the bar section 166. The connective member 160 and attached driver link 142 displace frontward and rearward along the slot 132 as a single unit to drive the linkage 116.

The remainder of the second embodiment of the toy vehicle 110 is substantially the same as the corresponding elements of the first embodiment of the toy vehicle 10 as described above, except that the second embodiment toy vehicle 110 does not include pinion gears or a gear rack or any mechanisms equivalent thereto. These are replaced by the transmitting arms 162A, 162B.

Referring again to FIGS. 10–17, in the use of the second embodiment toy vehicle 110 generally, rotation of the finger tabs 118A, 118B rotates the transmitting arms 162A, 162B, displaces the connective member 160 and drives the linkage 116 in a frontward or rearward direction and rotates the shell halves 114A, 114B within a plane(s) parallel to a horizontal plane through the chassis 112. The movement of the linkage 116 moves the simulated weapon 149 both perpendicular to and parallel with a horizontal plane through the chassis 112.

More specifically, with the body shell halves 114A, 114B disposed in an initial, closed position as described above, a user grasps the finger tabs 118A, 118B and pushes them toward each other. Movement of the finger tabs 118A, 118B in directions toward each other simultaneously rotates the shell halves 114A, 114B away from each other to open the enclosed space 135 and displaces the simulated weapon 149 along a path in a vertical longitudinal plane through vehicle 110, the path being perpendicularly away from, and frontwardly parallel with a horizontal plane through the chassis 112. Specifically, when the shell halves 114A, 114B rotate away from each other, the transmitting arms 162A, 162B each rotate in opposite directions in a scissor-like manner so that free ends 163A, 163B of the transmitting arms 162A, 162B move generally frontward. The free ends 163A, 163B push against the contacting surface 168, thereby causing the connective member 160 and attached driver link 142 to move along the slot 132 in a frontward direction. The frontward movement of the driver link 142 drives the remainder of the linkage 116 so that the connecting link 144 and the driven link 146 both move generally frontwardly to a second position. When the linkage 116 is in the second position, the simulated weapon 149 projects into view frontwardly and outwardly from the space previously enclosed by the shell halves 114A, 114B.

In contrast to the first embodiment of the toy vehicle 10, rotation of the finger tabs 118A, 118B away from each other does not cause the linkage 116 to move rearwardly from the second position back to the first position because the transmitting arms 162A, 162B, which connect the finger tabs 118A, 118B with the linkage 116, are not attached to the linkage 116. Therefore, a user must reset the linkage 116, such as by manually pushing the weapon or some other portion of the linkage 116 rearwardly to the first position, such that the simulated weapon moves rearward parallel with, and perpendicularly downward toward a horizontal plane through the chassis 112. After the linkage 116 has been manually reset to the first position as described above, the user may then move or pull the finger tabs 118A, 118B away from each other to rotate the shell halves 114A, 114B toward each other to the first position. If desired, the linkage 116 can be made to be driven in reverse, for example by providing arms 162A, 162B with slots (not shown) along their length each receiving a pin (not shown) on the connective member 160.

Referring now to FIGS. 18–22, there is shown a third embodiment of a toy vehicle 210, which is a hybrid of the first embodiment of the toy vehicle 10 and the second embodiment of the toy vehicle 110, as both are described above. As with the first and second embodiment toy vehicles 10 and 210, respectively, the third embodiment of the toy vehicle 210 is generally comprised of a chassis 212, a pair of body panel/shell halves 214A, 214B, a linkage 216 and a pair of finger tabs 218A, 218B.

The chassis 212 of the third embodiment toy vehicle 210 is substantially identical to the chassis 12 of the first embodiment toy vehicle 10, except that the chassis 212 does not include hinge supports. The linkage 216 is substantially identical to, and operates substantially identically as, the linkage 16 of the first embodiment toy vehicle 10, with the exception that the driven link 246 of the linkage 216 does not have manipulating arms. The finger tabs 218A, 218B and the shell halves 214A, 214B are substantially identical to, and operate substantially identically as, the finger tabs 118A, 118B and the shell halves 114A, 114B of the second embodiment toy vehicle 110, except that the shell halves 214A, 214B do not include transmitting arms. As with the shell halves 114A, 114B of the second embodiment, the shell halves 214A, 214B are rotatable in a plane(s) parallel with a horizontal plane through the chassis 212 and form a vehicle body 234 in an initial or first position in which the linkage 216 is hidden from view.

Referring again to FIGS. 18–22, in use, the third embodiment of the toy vehicle 210 functions partly in the same manner as the first embodiment toy vehicle 10 and partly in the same manner as the second embodiment toy vehicle 110. With the toy vehicle 210 disposed in a first position described above, a user grasps the finger tabs 218A, 218B and pushes them toward each other. Movement of the finger tabs 218A, 218B toward each other simultaneously rotates the shell halves 214A, 214B away from each other to open the enclosed space 235 and displaces the simulated weapon 249 perpendicularly upward from, and frontwardly parallel with, a horizontal plane through the chassis 212.

More specifically, rotation of each finger tab 218A, 218B toward the other finger tab 218B, 218A causes each shell half 214A, 214B to rotate about the respective shaft 254A, 254B in a direction away from the other shell half 214B, 214A. Simultaneously, pinion gears 256A, 256B on shafts 254A, 254B rotate in relative directions such that a rack 258 displaces frontwardly and moves the connective member 260 frontwardly to drive the linkage 216 in a generally frontward direction. As with the first and second embodiments, the frontward movement of the linkage 216 to a second position causes the simulated weapon 249 to become projected upwardly and frontwardly outward into view from the space formerly enclosed by the shell halves 214A, 214B along a path in the vertical, longitudinal plane of the vehicle 210 and the chassis 212.

To return the third embodiment of the toy vehicle 210 to the first position, a user grasps the finger tabs 218A, 218B and pulls them away from each other to simultaneously rotate the shell halves 214A, 214B toward each other and displace the linkage 216 including the simulated weapon 249 perpendicularly downward toward, and rearwardly parallel with, a horizontal plane through the chassis 212. Alternatively, the simulated weapon 249 or other portion of the linkage 216 and/or the shell halves 214A, 214B can be manually pushed back to its or their initial position(s) to return the whole toy vehicle 210 to the initial position.

Although the linkages 16, 216 of the first and third embodiments 10, 210, respectively, are described and depicted as double-rocker mechanisms and the linkage 116 of the second embodiment 110 is described and depicted as a slider-crank mechanism of the in-line variety, it will be appreciated by those skilled in the art that other types of four-bar linkages of either a Grashof or a non-Grashof variety can be substituted for any or all of the linkages described herein. For example, a crank rocker mechanism, a drag link mechanism, a change-point mechanism, a triple rocker mechanism or an offset slider-crank can be substituted for any or all of the linkages 16, 116 and 216. Further, although the linkages 16, 116, 216 described herein are operated in a "non-Grashof manner" so that no link rotates a full 360 degrees, it is within the scope of the present invention to construct and operate any of the linkages 16, 116, 216 in the manner of a "true" Grashof mechanism so that the simulated weapon 49, 149, 249 and the shell halves 14, 114, 214 move from the initial position to the second position and back again while the finger tabs 18, 118, 218 move in only a single relative direction. The present invention is intended to cover all appropriate types of four-bar linkages operated in any appropriate manner. As an alternative, the finger tabs may be supported for rotation on the chassis like tabs 18A, 18B but provided with transmitting arms or similar functioning cam elements on a lower side of the chassis where the cam elements can contact an extension of a connective member like member 160 to push the member and a connected driver link (like link 142) forward. As an alternative to pulling down the top opening shell halves of a vehicle as is shown in FIG. 9, with respect to the first embodiment vehicle, the shell halves can be pivoted back to their upright position by cam members which are made to extend transversely outwardly against the shells below their pivot axes. These cam members can be controlled by the forward/rearward movement of the linkage or the portion of the mechanism driving the linkage and driven by the finger tabs. It will further be appreciated that components of various described embodiments can be mixed and matched to a significant extent.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A toy vehicle comprising:

a chassis;

a pair of shell halves rotatably attached to said chassis and forming a vehicle body in a first position, said vehicle body bounding an interior space;

a linkage attached to said chassis and disposed at least partially within said interior space; and a pair of finger tabs pivotally attached to said chassis and connected with said linkage, said finger tabs being disposed externally of said shell halves and rotatable with respect to each other and said chassis, such that movement of said finger tabs drives said linkage and rotates said shell halves.

2. The toy vehicle as recited in claim 1 further comprising a simulated weapon carried by said linkage, said simulated weapon being at least hidden from view from above said vehicle when said shell halves are in said first position.

3. The toy vehicle as recited in claim 2 wherein movement of said linkage moves said simulated weapon along a path in a vertical plane extending longitudinally through said chassis.

4. The toy vehicle as recited in claim 2 wherein movement of said finger tabs in a direction toward each other simultaneously rotates said shell halves away from each other to open said enclosed space and displace said simulated weapon along a path in a vertical plane extending longitudinally through said chassis.

5. The toy vehicle as recited in claim 1 wherein said linkage includes:

a driver link movably attached to said chassis and connected with said finger tabs;

a connecting link having a first end and a second end, said first end being connected to said driver link; and a driven link rotatably attached to said chassis and connected to said second end of said connecting link.

6. The toy vehicle as recited in claim 5 wherein said connecting link forms a simulated weapon.

7. The toy vehicle as recited in claim 1, wherein rotation of said finger tabs towards each other causes said shell halves to rotate away from each other.

8. The toy vehicle as recited in claim 7, wherein rotation of said finger tabs away from each other causes said shell halves to rotate toward each other.

9. The toy vehicle as recited in claim 1 wherein said shell halves form in said first position a caricature of a head of one of a human, a humanoid, an animal and a fantastical creature.

10. The toy vehicle as recited in claim 1 further comprising at least two wheels connected with said chassis.

11. The toy vehicle as recited in claim 1, wherein said chassis has an at least generally horizontal surface and said shell halves rotate within a plane extending at least generally perpendicularly to said horizontal surface.

12. The toy vehicle as recited in claim 1 further comprising at least one pinion gear attached to one of said finger tabs and a gear rack displaceably attached to said chassis, said gear rack being engaged with said pinion gear and connected with said linkage, such that rotation of said finger tabs rotates said at least one pinion gear, displaces said gear rack and drives said linkage.

13. The toy vehicle as recited in claim 1 wherein said linkage has a pair of manipulating arms extending outwardly from opposite sides of said linkage each of said shell halves has an inwardly-extending ledge with an upper surface, and each manipulating arm contacts said upper surface of a separate one of said ledges, such that movement of said linkage in a first direction moves said manipulating arms along said upper surfaces of said ledges in said first direction to allow said shell halves to rotate away from each other and movement of said linkage in a second, opposite direction moves said manipulating arms along said upper surfaces of said ledges in said second, opposite direction to rotate said shell halves toward each other.

14. The toy vehicle as recited in claim 1 wherein said chassis has an at least generally horizontal surface and said shell halves rotate within a plane at least generally parallel to said horizontal surface.

15. The toy vehicle as recited in claim 1 further comprising a surface of said chassis including a slot and a connective member slidable along said slot and attached to said linkage and wherein said finger tabs are each attached to a separate one of said shell halves, each of said shell halves has a transmitting arm extending from an inner surface of said shell half and acting upon said connective member, and rotation of said finger tabs rotates said transmitting arms, displaces said connective member and drives said linkage.

16. A toy vehicle comprising:

a chassis;

at least one body panel rotatably attached to said chassis;

a four-bar linkage attached to said chassis and disposed at least partially beneath said body panel in a first position;

at least one simulated weapon carried by said four-bar linkage;

at least one finger tab rotatably attached to said chassis and connected with said four-bar linkage, said finger tab driving said linkage and rotating said body panel such that said simulated weapon is projected from beneath said body panel;

a pinion gear attached to said finger tab; and a gear rack displaceably attached to said chassis, said gear rack being engaged with said pinion gear and connected with said four-bar linkage, wherein rotation of said finger tab rotates said pinion gear, displaces said gear rack and drives said four-bar linkage.

17. The toy vehicle as recited in claim 16 wherein movement of said four-bar linkage moves said simulated weapon along a path in a plane extending vertically and longitudinally through said vehicle.

18. The toy vehicle as recited in claim 16 wherein a link of said four-bar linkage forms said simulated weapon.

19. The toy vehicle as recited in claim 16 further comprising at least two wheels connected with said chassis.

20. A toy vehicle comprising:

a chassis;

at least one body panel rotatable attached to said chassis;

a four-bar linkage attached to said chassis and disposed at least partially beneath said body panel in a first position;

at least one simulated weapon carried by said four-bar linkage;

at least one finger tab rotatable attached to said chassis and connected with said four-bar linkage, said finger tab driving said linkage and rotating said body panel such that said simulated weapon is projected from beneath said body panel; and a surface defining a slot connected with said chassis and a connective member slidably disposed within said slot and attached to said four-bar linkage and wherein said finger tab is attached to an outer surface of said body panel, said body panel has a transmitting arm extending from an inner surface and acting upon said connective member, and rotation of said finger tab rotates said transmitting arm, displaces said connective member and drives said four-bar linkage.

* * * * *